United States Patent [19]

Field et al.

[11] 4,411,254

[45] Oct. 25, 1983

[54] COUNTERTOP RANGE WITH PROXIMITY VENTILATION AND ELECTRONIC AIR CLEANER

[75] Inventors: Thomas R. Field, Noblesville; Donald J. Simon, Indianapolis, both of Ind.

[73] Assignee: The Jenn-Air Corporation, Indianapolis, Ind.

[21] Appl. No.: 257,497

[22] Filed: Apr. 24, 1981

[51] Int. Cl.[3] ..... F24C 15/20

[52] U.S. Cl. ..... 126/300; 126/299 D; 126/299 F; 55/DIG. 36

[58] Field of Search ..... 126/299 D, 299 R, 299 F, 126/300, 299 E; 55/126, 385 A R, 472, 473, DIG. 36

[56] References Cited

U.S. PATENT DOCUMENTS

| | | | |
|---|---|---|---|
| 2,674,991 | 4/1954 | Schaefer | 126/299 R |
| 3,367,320 | 2/1968 | Jenn et al. | 126/300 |
| 3,391,689 | 7/1968 | Roger | 55/385 R |
| 3,409,005 | 11/1968 | Field | 126/299 R |
| 3,747,301 | 7/1973 | Glover et al. | 55/DIG. 36 |
| 3,926,171 | 12/1975 | Kurek et al. | 126/21 |
| 3,956,458 | 5/1976 | Anderson | 55/126 |
| 4,244,710 | 1/1981 | Burger | 55/DIG. 36 |
| 4,333,745 | 6/1982 | Zeannick | 55/472 X |
| 4,344,784 | 8/1982 | Delkas et al. | 55/385 A X |

FOREIGN PATENT DOCUMENTS

| | | | |
|---|---|---|---|
| 1156581 | 5/1958 | France | 126/299 A |

*Primary Examiner*—Larry Jones
*Assistant Examiner*—Kenichi Okuno
*Attorney, Agent, or Firm*—Richard L. Ward

[57] ABSTRACT

Disclosed is a proximity ventilated cooking range adapted for countertop installation in a conventional stack-on kitchen cabinet. The surface heating units and ventilating air intake rest over a cut-out portion of the cabinet countertop with a ventilating air plenum and motor driven fan depending from the top surface of the range and disposed in the underlying cabinet. A housing enclosing an electronic air filtering unit is mounted closely adjacent the ventilating air plenum with a duct connecting the discharge of the fan and the interior of the filter unit housing. After moving through the filter unit, the air exits from the housing through a discharge opening at the front of the cabinet into the kitchen environs.

5 Claims, 5 Drawing Figures

COUNTERTOP RANGE WITH PROXIMITY VENTILATION AND ELECTRONIC AIR CLEANER

BACKGROUND OF THE INVENTION

Cooking ranges of the proximity ventilated type are well known in the prior art. Ranges of this type may include an oven and can be of either the free-standing or drop-in variety, or can be of the type where the range does not include an oven and provides surface cooking units only, these being set in an opening cut into the counter area of a conventional stack-on type kitchen cabinet. The surface units are separate from the oven component and may be installed in island or penninsular cabinet arrangements. A ventilated, countertop unit of the type referred to is disclosed in U.S. Pat. No. 3,444,805. Conventionally, the apparatus incloses an array of surface units carried on an upper housing which extends into the underlying carbinet. Means forming a ventilating air plenum depends from the top plate and a motor driven fan or blower wheel moves air from a surface-located intake, through the plenum, and delivers it to a discharge duct leading to the outdoors.

The concept of the present invention envisions use of the apparatus described above but incorporates, additionally, an electronic air cleaner or filter of the well-known electrostatic precipatator type so that the filtered air may be discharged back into the kitchen environs and need not be vented to the exterior of the house. Use of an electrostatic precipatator type filter in a ventilated domestic range is shown in U.S. Pat. No. 3,260,189 but the structure is a free standing range and the filtered air is recirculated within the range, not discharged in the room in which the range is located and is not adapted for countertop installation.

The preferred embodiment of the present invention can be installed in a standard, stack-on cabinet without any modification of the cabinet itself by cutting away of a portion of the countertop to accommodate the surface units of the range. The other embodiments of the invention require only modification of the cabinet doors to provide a discharge opening. The primary feature of the present invention, therefore, is the provision of a ventilated countertop range, having an electronic filter component which can be installed in a standard, stack-on type kitchen cabinet with minimum alteration of the cabinet.

DESCRIPTION OF THE PREFERRED EMBODIMENTS

Figure 1:
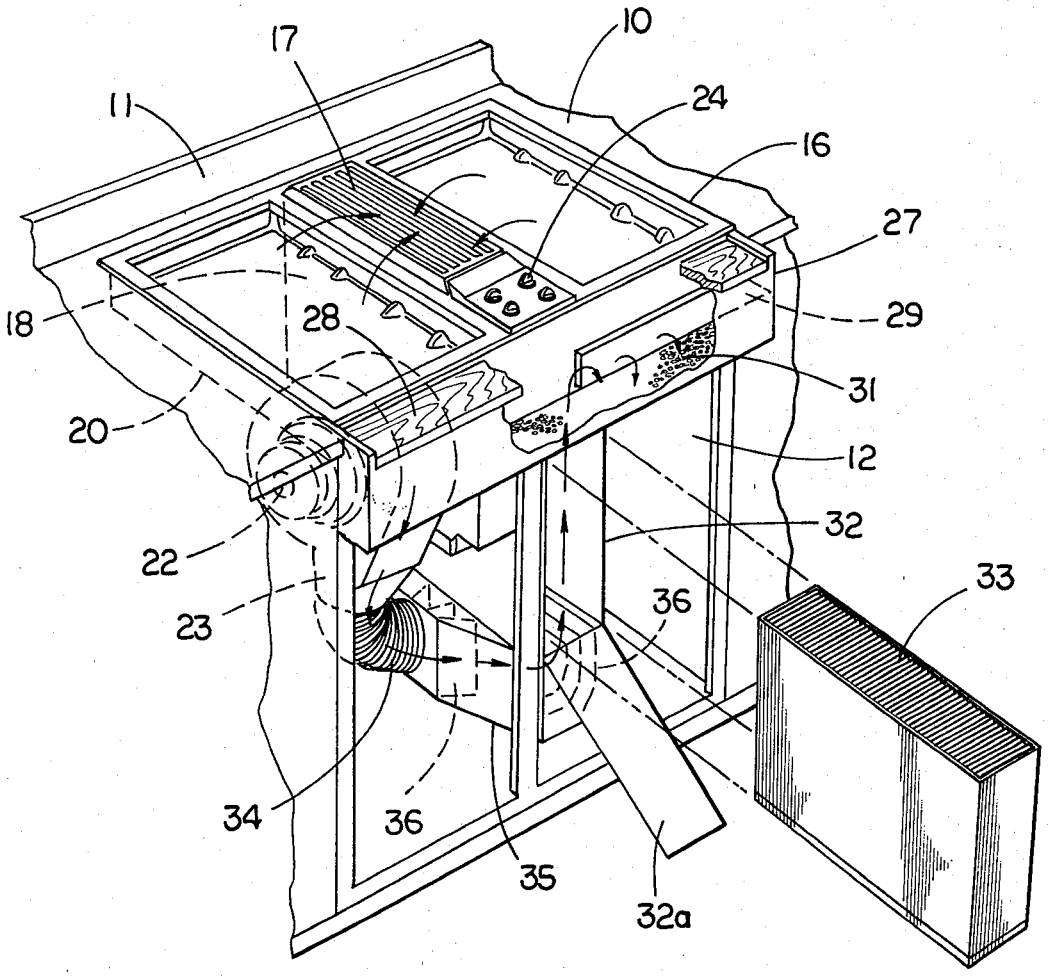
FIG. 1 is a perspective, partially exploded view of the preferred embodiment of the present invention.
Figure 2:
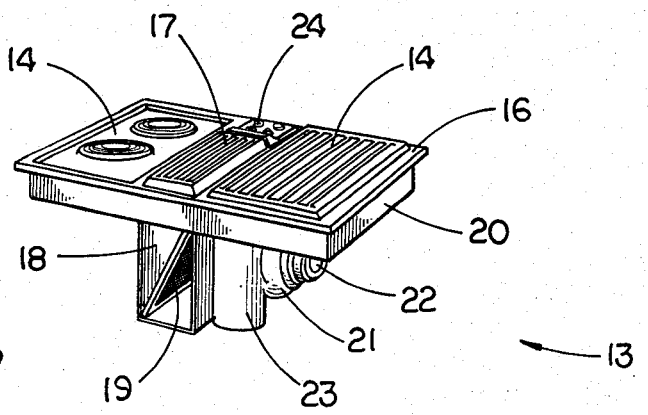
FIG. 2 is a perspective view of the range prior to installation and without the electronic filter component.

Referring initially to FIGS. 1 and 2, a conventional stack-on kitchen cabinet is shown having a countertop 10, splash plate 11, and lower door openings 12 (the hinged doors being omitted to prevent obscuring the showing of the apparatus of the present invention). A ventilated surface range unit 13 (FIG. 2) is inserted into a cut-out portion of the countertop. The surface unit 13 is of the type disclosed in U.S. Pat. No. 3,444,805 and includes plug-in type subunits 14 within a framing member 16 with a housing box 20 extending below member 16. A surface ventilating intake 17 takes moisture and odor laden air into an enclosure 18 (shown with rear face removed in FIG. 2) which contains a fibrous filter 19 and forms an air plenum through which odors and fume-bearing air is drawn by the air moving means 21 (which may take the form of a centrifugal fan) driven by electrical motor 22 and having a discharge duct 23. Controls for the surface units and fan are indicated at generally 24.

Figure 3:
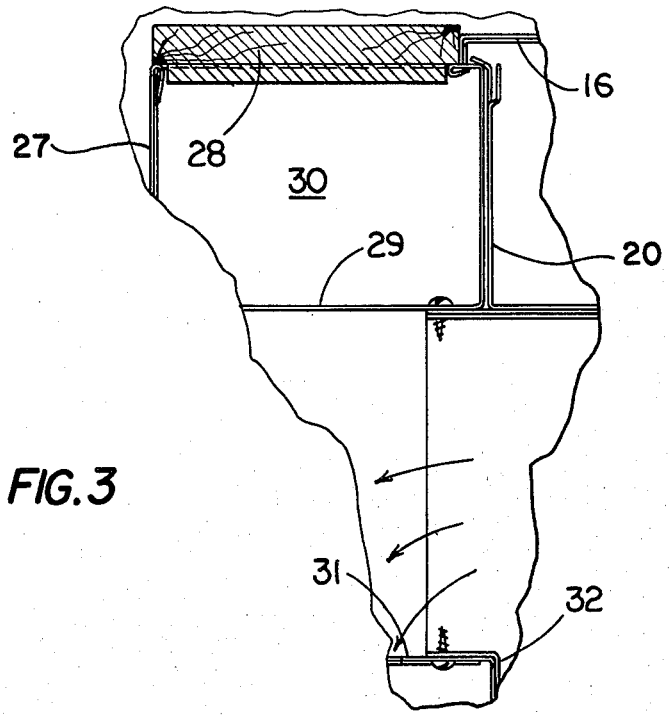
FIG. 3 is an enlarged, fragmentary side view of a portion of the apparatus shown in FIG. 1.

As may be seen in FIGS. 1 and 3, the housing 20 has joined to it an extension portion 27 which extends outwardly of and overhangs the underlying cabinet door openings. The top closure for the extending portion 27 may take the form of a removable cutting board 28 and the central, horizontal partition 29 provides a storage area 30 (FIG. 3) for kichen implements, access to which may be attained by lifting the removable cutting board 28. The elongated, rectangular area between partition 29 and the perforated base plate 31 serves as a discharge passage and discharge aperture for air moving upwardly through a filter unit housing 32. The housing 32 accommodates an electronic filter unit, indicated at 33, of the generally known, electrostatic precipitator type. A hinged door **32*a* permits removal of the filter unit from housing 32 for service or cleaning. A fitting 35 joins the flexible fan discharge duct 34 to the base of housing 32. Guide vanes 36 are present in the fitting 35 to minimize turbulence in directing the air flow from duct 34 into housing 32. The air, after flowing through filter unit 33, moves into the elongated chamber between partition 29 and perforated base 31 to exit downwardly through the apertures in base 31 into the kitchen environs, the cleansed air flow being directed downward along the front surface of the underlying cabinet. A preferred sequence of installation for the components described above provides for initially installing the filter unit housing 32. The surface range unit 13 with air moving means 21, as shown in FIG. 2, may then be installed and the air moving means 21 operatively connected to the fitting 35 by fastening the flexible discharge duct 34 between the discharge duct 23 and the fitting 35**.

Figure 4:
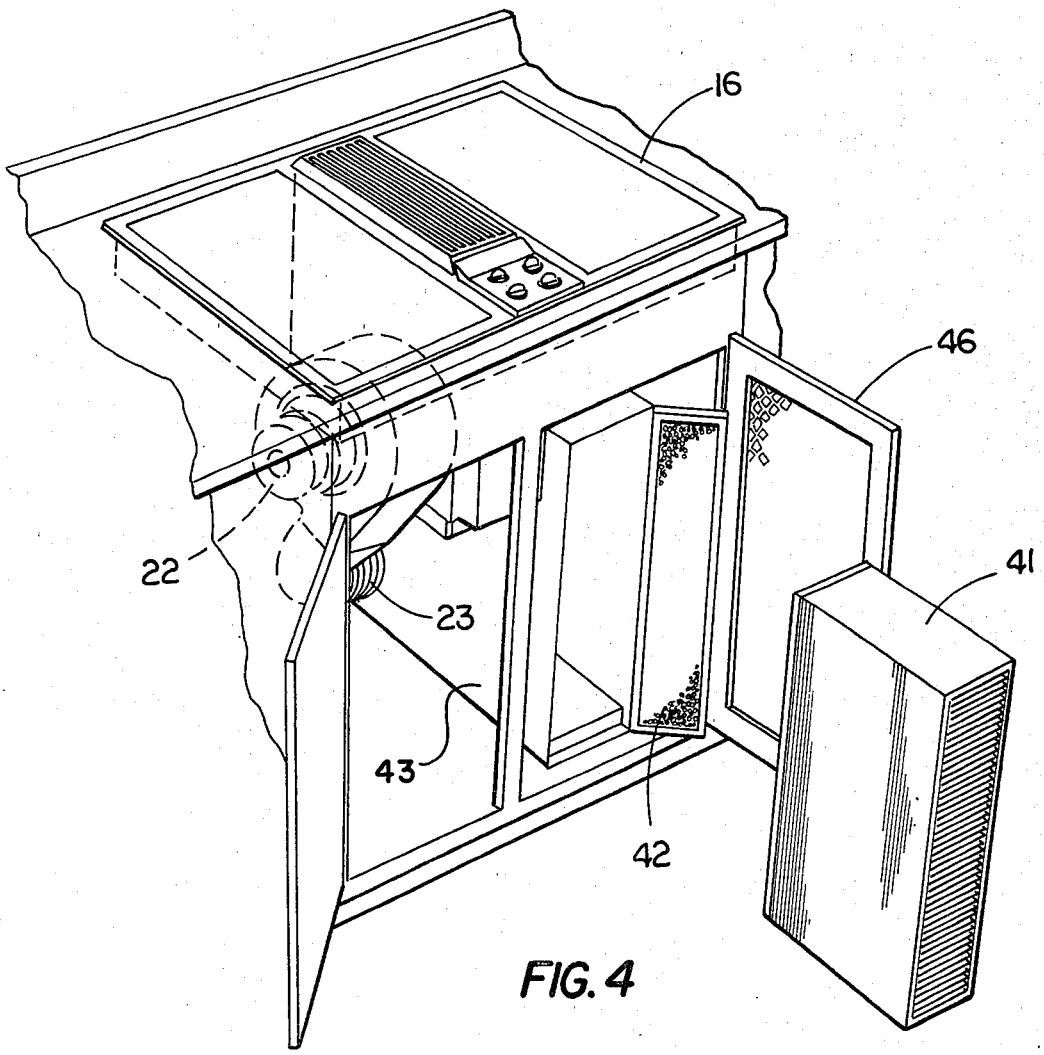
FIG. 4 is a view similar to FIG. 1 but showing a modified form of the invention.

FIG. 4 shows a modified form of the structure which differs from that of FIG. 1 in that exhaust from the electronic filter unit 41 moves through the hinged, perforated door 42 in the housing 43. Since the air flow path is through the door 42 outwardly, the cabinet door 46 registering with door 42 must be altered by perforating it to permit the air stream to exit into the kitchen environs.

Figure 5:
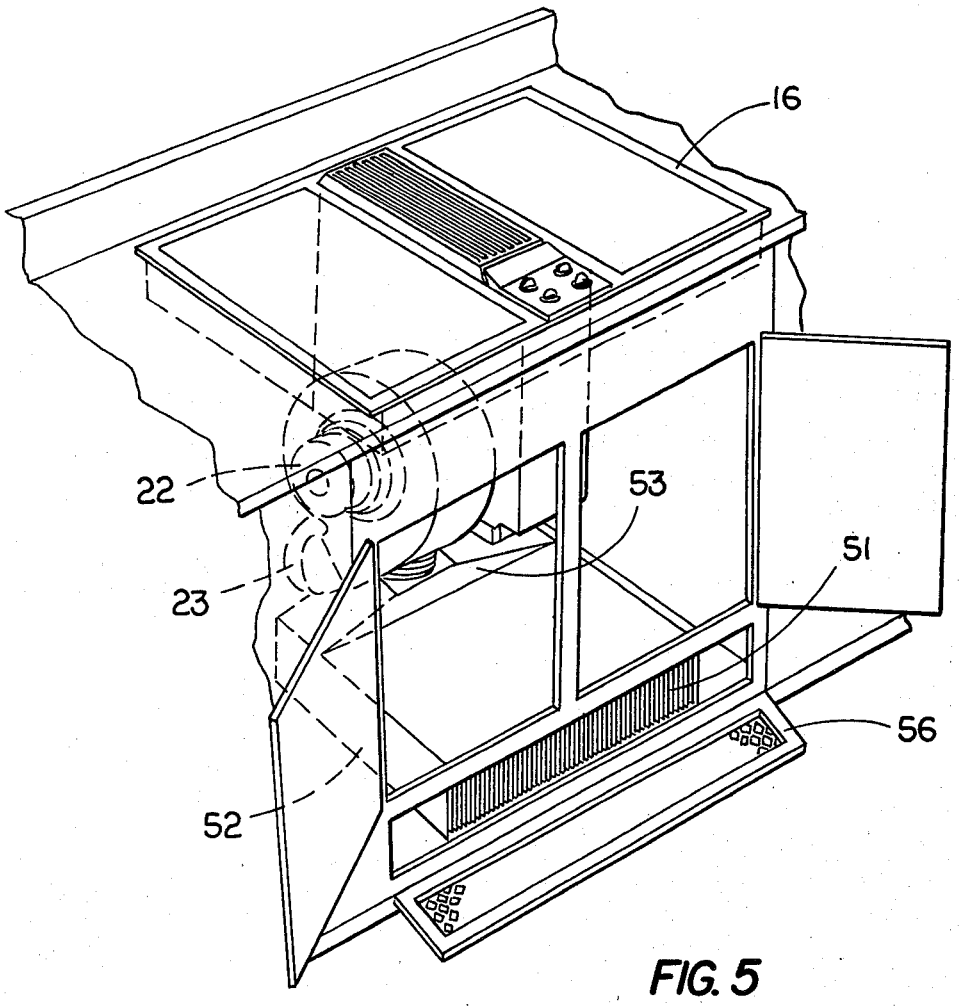
FIG. 5 is a view similar to FIG. 4 but showing a still further modified form of the invention.

FIG. 5 illustrates a further modified form of the structure and differs from that of FIG. 4 in that the electronic filter unit 51, in housing 52, is installed on the base of the cabinet with fitting 53 connecting the fan exhaust to the housing 52. The air stream passes through unit 51 and exits through perforated cabinet door 56. Again, the cabinet front must be modified somewhat to provide the perforated access door 56 extending adjacent the base of the cabinet front surface. The door 56 is hinged to permit access to filter unit 51.

In all three forms of the invention described the frame 16 may be modified to extend to the splash plate 11 (FIG. 1) and be provided with a matching upwardly extending portion which replaces the splash plate portion which spans the range unit. With this arrangement, the installer need not provide a countertop over the range area (with most of the top being cut away to accommodate the range). A savings in installation cost, because the countertop need not be continuous (reducing the total, necessary countertop length), is thus a feature of this modified form.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. In a cooking range assembly for installation in a conventional stack-on kitchen cabinet having a countertop and underlying cabinet doors, said assembly being of the type having a drop-in range component with surface heating units and a proximity ventilating air intake on its top surface and including an enclosure forming a ventilating air plenum chamber and mounting a motor-driven fan having a discharge fitting and further including a first air filtering member housed in said enclosure spaced from said air intake and upstream from said fan, said chamber and fan depending beneath said top surface, said drop-in range component being accommodated in a cut-out portion of the cabinet countertop, the improvement comprising a housing downstream from said fan discharge fitting and including a second air filtering member in the form of an electrostatic air filtering unit, said housing being mounted closely adjacent said plenum chamber within the cabinet, a conduit connecting said fan discharge fitting and the interior of said filtering unit housing, and a discharge passage for said housing terminating at a discharge means including an extension chamber overhanging said cabinet doors and further including an aperture at the front of the cabinet and beneath the countertop for discharging filtered air generally downwardly along the exterior face of said cabinet doors into the kitchen environs.

2. A cooking range assembly as claimed in claim 1 in which said housing has an access door registering with at least one of said cabinet doors permitting removal of said filtering unit for servicing through the cabinet door.

3. In a cooking range assembly for installation in a conventional stack-on kitchen cabinet having a countertop and underlying cabinet doors, said assembly being of the type having a drop-in range component with surface heating units and a proximity ventilating air intake on its top surface and including a ventilating air plenum chamber with a motor-driven fan having a discharge fitting, said chamber and fan depending beneath said top surface, said drop-in range component being accommodated in a cut-out portion of the cabinet countertop, the improvement comprising a housing and an electrostatic air filtering unit enclosed therein, said housing being mounted closely adjacent said plenum chamber within the cabinet, a conduit connecting said fan discharge fitting and the interior of said filtering unit housing, and a discharge passage for said housing terminating in a discharge aperture at the front of the cabinet and beneath the countertop just below said top surface of the range component and extending for substantially the complete width thereof, said discharge aperture including an extension chamber spanning the width of said range component and extending outwardly to overhang said cabinet doors, the lower surface of the overhanging portion being perforated to form said housing discharge aperture thereby directing filtered airflow downwardly along the exterior face of the cabinet doors into the kitchen environs.

4. A cooking range as claimed in claim 3 in which the upper surface of said overhanging portion supports an overlying cutting board at substantially the same horizontal level as the countertop.

5. A cooking range assembly as claimed in claim 3 in which said filter unit housing is located contiguous to and at one side of said air plenum chamber and said connecting conduit communicates with the base of said filter housing whereby said fan moves air upwardly through said filtering unit to said housing discharge aperture.

* * * * *